US006065213A

United States Patent [19]

Rivera

[11] Patent Number: 6,065,213

[45] Date of Patent: May 23, 2000

[54] FOLDING SCISSORS

[75] Inventor: Benjamin C. Rivera, West Linn, Oreg.

[73] Assignee: Leatherman Tool Group, Inc., Portland, Oreg.

[21] Appl. No.: 09/187,819

[22] Filed: Nov. 6, 1998

[51] Int. Cl.[7] ..... B26B 13/00

[52] U.S. Cl. ..... 30/155; 30/255; 7/128

[58] Field of Search ..... 30/146, 155, 255; 7/128, 118, 134, 135, 158, 160; 81/177.4, 427.5

[56] References Cited

U.S. PATENT DOCUMENTS

| | | | |
|---|---|---|---|
| 330,738 | 11/1885 | Richard et al. . | |
| 502,809 | 8/1893 | Caspian . | |
| 884,281 | 4/1908 | Lindal . | |
| 1,356,119 | 10/1920 | Bassisty . | |
| 1,969,129 | 8/1934 | Harz . | |
| 4,658,456 | 4/1987 | Tsai | 7/135 |
| 5,142,721 | 9/1992 | Sessions et al. | 7/128 |
| 5,745,997 | 5/1998 | Berg et al. | 30/155 |
| 5,857,268 | 1/1999 | Park | 30/146 |

FOREIGN PATENT DOCUMENTS

| | | |
|---|---|---|
| 2322229 | 5/1974 | Germany . |
| 2295570 | 6/1996 | United Kingdom . |

OTHER PUBLICATIONS

Slip 'n' Snip collapsible scissors at least as early as Nov. 29, 1994.

Folding scissors at least as early as Nov. 29, 1994.

*Primary Examiner*—Hwei-Siu Payer
*Attorney, Agent, or Firm*—Chernoff, Vilhauer, McClung & Stenzel, LLP

[57] ABSTRACT

A folding scissors of a type suitable for inclusion in a compact multipurpose tool, in which an operating lever securely engages one of the scissors blades to move it with respect to the other, and in which a spacer takes up excess clearance to keep the operating lever drivingly engaged with one of the scissors blades and to keep the sharp edges of the scissors properly close together during use of the scissors. Inclined mating surfaces are provided on the lever arm and on a hook on one of the scissors blades to keep the operating lever engaged with the scissors blade. A cavity is provided to receive the spacer when the scissors is in its folded configuration in order to facilitate relative movement of the parts of the scissors during the process of folding and unfolding the scissors.

13 Claims, 4 Drawing Sheets

84
78
70
72

94
48
110
50
108
106
44
26

28
86
62
24
82
68
78
35
80
96
56
94

70
78
84
28
92
86
110
48
46
76
70
74
88
72

FOLDING SCISSORS

BACKGROUND OF THE INVENTION

The present invention relates to scissors, and in particular to folding scissors of a type that can be included in compact multipurpose hand tools.

One type of folding scissors used in compact multipurpose tools such as the model PST II™ tool manufactured by Leatherman Tool Group, Inc., the assignee of the present invention, includes a first blade attached to a handle in which the entire scissors can be stored when folded. A second blade is attached to the first blade through a pivot assembly, and a small operating lever for the second blade also moves with respect to both blades, about the axis of the same pivot assembly. In an operating configuration the operating lever of such folding scissors moves the second blade with respect to the first blade. Scissors of this type are disclosed in U.S. Pat. No. 5,745,997.

For use of such scissors in a compact multipurpose tool the operating lever and each of the blades must be large enough to have sufficient strength, yet the scissors should be small enough to be able to be folded and stored within a the handle of the multipurpose tool. For this reason the interconnection between the operating lever and the second blade should not unduly increase the width of the scissors.

At the same time, when the scissors are in use the connection between the operating lever and the second blade must be capable of carrying a reasonable amount of force, so that the scissors can be used to cut materials of a reasonable thickness and toughness.

It is necessary to keep the sharp edges of scissors blades substantially in contact with each other during use. In ordinary scissors excess clearance between the sharp edges of cooperating blades is often reduced by urging the scissors handles apart, so that the sharpened edges are urged together by reaction about the pivot shaft interconnecting the scissors blades. When this same type of force is applied to the operating lever of folding scissors of the type described in the previously-mentioned U.S. Pat. No. 5,745,997, if there is excessive axial clearance along the pivot shaft, the operating lever could be urged laterally out of driving engagement with the second blade. It is possible to reduce this likelihood by constructing the scissors with careful control of the amount of axial clearance in the pivot joint between the scissors blades and the operating lever. The amount of clearance is critical, though, since too little clearance between the blades can make it unduly difficult to move the blades with respect to each other. At the same time, while it should be easy to move the operating lever between its operational position and its folded position, during use of the scissors the operating lever should remain engaged with the adjacent blade.

What is needed, then, is a pair of folding scissors of the general type described above in which the operating lever remains safely and securely engaged with the adjacent blade while a reasonable amount of force is applied to close the scissors blades toward each other in a cutting action, with the sharp edges of the scissors blades held closely enough together to cut efficiently, and yet the scissors should be able to be folded and unfolded easily.

SUMMARY OF THE INVENTION

The present invention overcomes the aforementioned shortcomings and supplies an answer to the aforementioned needs for improvements in folding scissors, by providing folding scissors including a first blade, a second blade, and an operating lever all pivotally movable with respect to each other, between a folded position and an operating position, and in which during use the operating lever is more securely engaged with one of the blades than in the prior art scissors of this type. In one embodiment of the invention respective engagement surfaces are provided on the operating lever and on a portion of the second blade, with the engagement surfaces oriented, with respect to each other and with respect to the pivot axis interconnecting the operating lever and the second blade, so that force exerted on the operating lever in a scissors blade-closing direction urges the operating lever laterally toward a base portion of the second blade, to keep the operating lever engaged securely with the second blade.

Another aspect of the invention is the provision of folding scissors in which two blades and an operating lever of the scissors all pivot about a common axis defined by a pivot shaft, and in which a spacer is located between a portion of the operating lever and one of the scissors blades when the operating lever is in a scissors-operating position with respect to that blade, so that the spacer takes up clearance along a pivot shaft in the pivot joint interconnecting the blades and the operating lever to keep the operating lever securely engaged with one of the blades when the operating lever is in such an operational position.

In one embodiment of the invention such a spacer is located between the second blade and a stabilizer portion of the operating lever when the operating lever is located in an extended, scissors-operating position with respect to the second blade.

In one embodiment of the invention a cavity is provided in the operating lever or the second blade to receive such a spacer so that the spacer is ineffective when the operating lever is in a folded position with respect to the second blade.

In one embodiment of the invention, the operating lever has a base portion including a stabilizer portion with a radius greater than that of a generally corresponding portion of previously known folding scissors, so that the operating lever may be engaged more stably with one of the scissors blades than was possible in previously known scissors of a similar type.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 2:
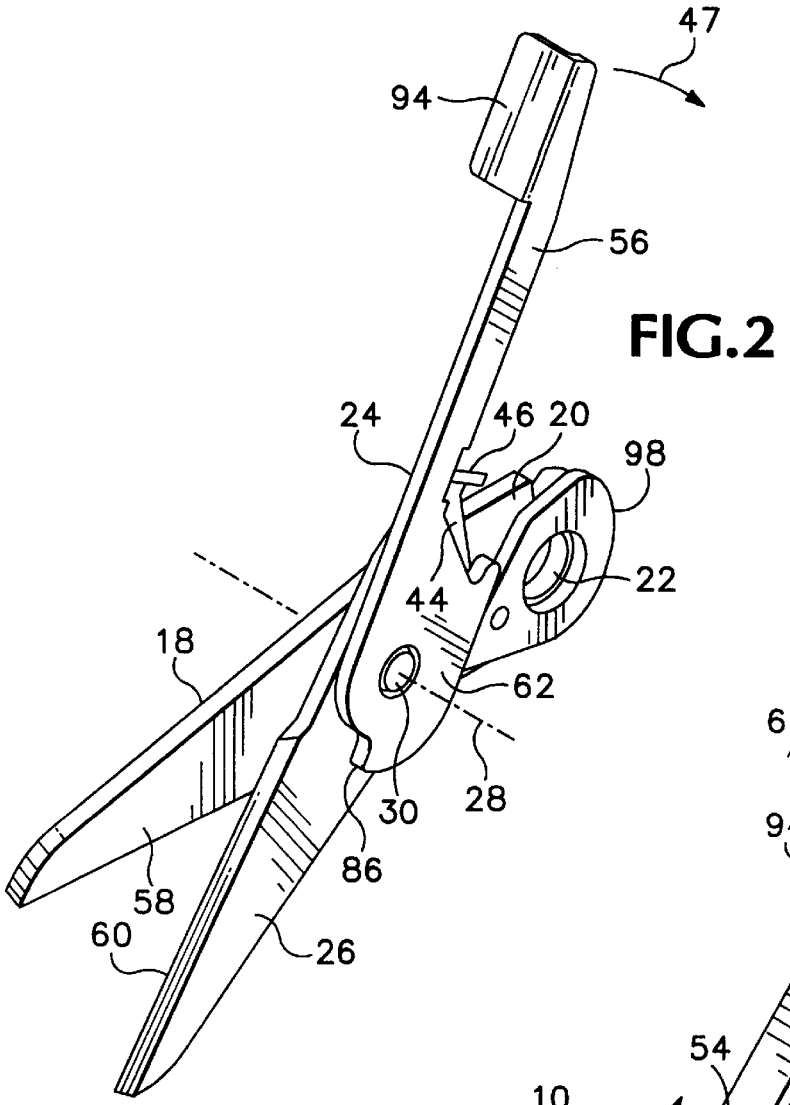
FIG. 2 is an isometric view of the scissors shown in FIG. 1, in the operating configuration shown in FIG. 1.
Figure 1:
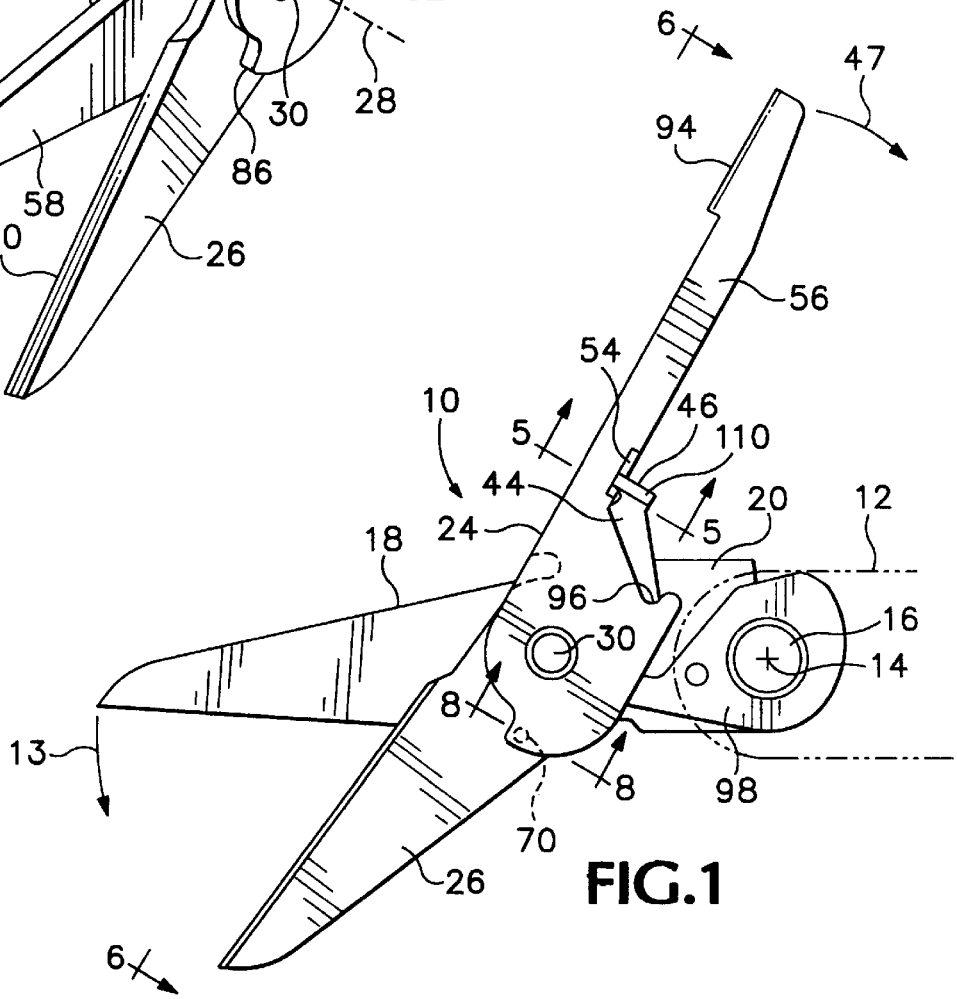
FIG. 1 is a side elevational view of a pair of folding scissors embodying the present invention, with the scissors shown in an operative configuration as part of a folding tool.

Referring now to the drawings which form a part of the disclosure herein, a pair of scissors 10 is shown in an operative configuration in FIGS. 1 and 2, extending outward from a handle 12 shown in phantom line. The folding scissors 10 may be stowed in a cavity defined by the handle 12 by being rotated in the direction of the arrow 13 about an axis 14 defined by a tool pivot shaft 16 mounted in the handle 12. A pair of scissors similar in many respects to the scissors of the present invention is disclosed in U.S. Pat. No. 5,745,997, entitled MULTIPURPOSE TOOL INCLUDING FOLDING SCISSORS, the disclosure of which is hereby incorporated herein by reference.

The pair of scissors 10 includes a first blade 18 having a base portion 20. As shown in FIG. 2, the base portion 20 of the first scissors blade 18 defines a bore 22 fitted about the tool pivot shaft 16 for rotation. The scissors 10 are movable from their stowed location within the handle 12 to the deployed position shown in FIGS. 1 and 2 by rotating the first blade 18 about the tool pivot shaft 16 in the handle 12. When ready for use the scissors 10 are in the position shown in FIG. 1.

Figure 3:
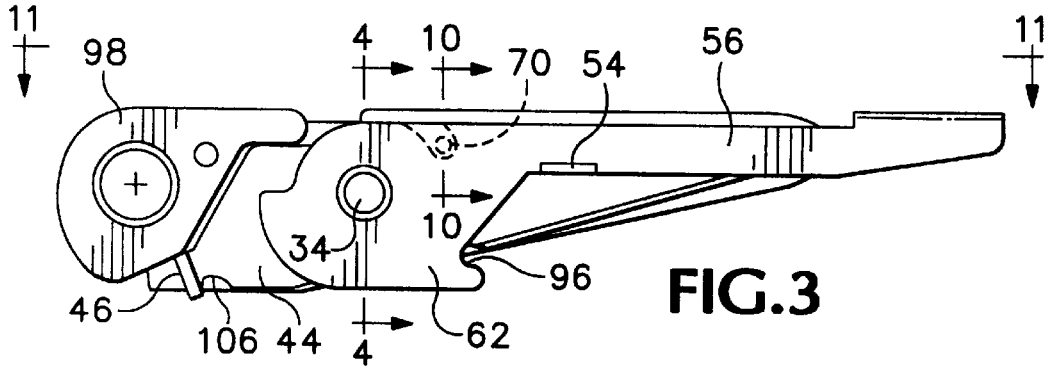
FIG. 3 is a side elevational view of the scissors shown in FIG. 1, in a folded configuration.
Figure 4:
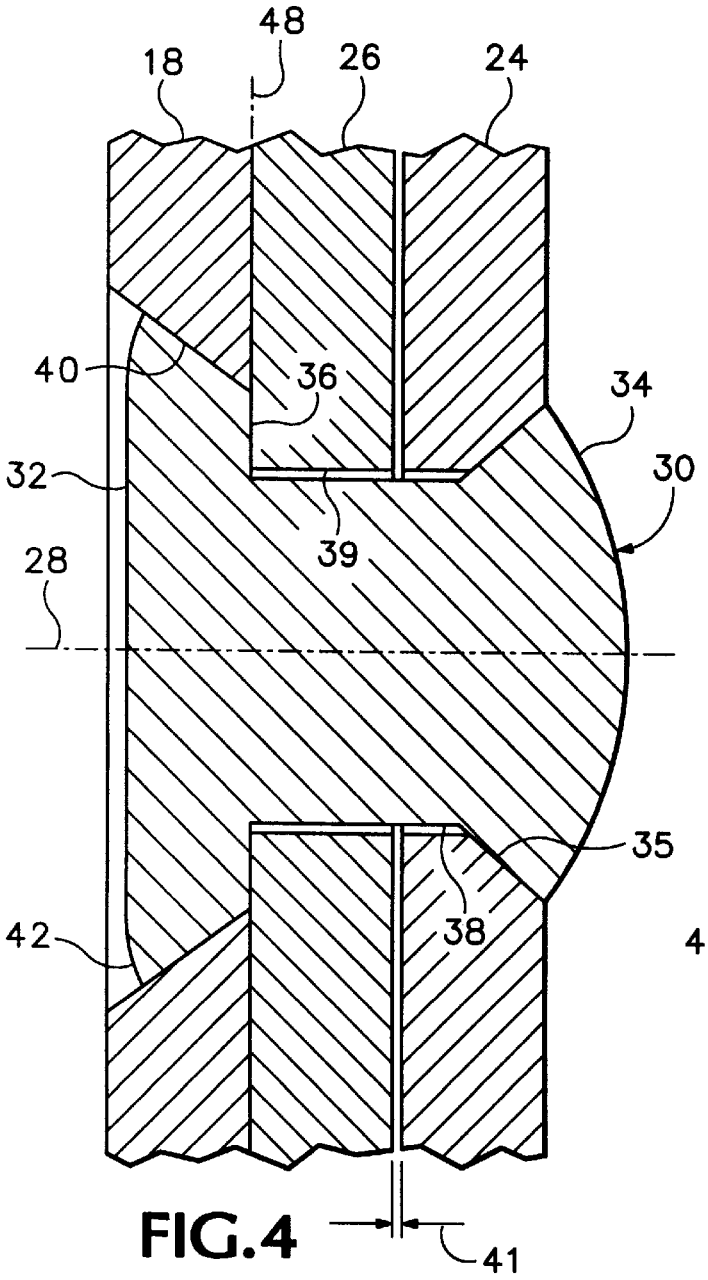
FIG. 4 is a section view taken along line 4—4 of FIG. 3, at an enlarged scale.

An operating lever 24 and a second blade 26 are attached to the first blade 18 for rotation about a scissors pivot axis 28 defined by a rivet 30 whose opposite ends are countersunk in the first blade 18 and the operating lever 24. Preferably, as shown in FIG. 4, a preformed head 32 of the rivet 30 is countersunk in a chamfered bore 40 in the first blade 18 to ensure clearance between the first blade 18 and a side wall of the handle 12 or an adjacent tool blade in a multipurpose tool. Slightly more clearance is normally available for the peened outer end 34 of the rivet 30 in a chamfered bore 35 in the operating lever 24 because of a spacer fitted on the tool pivot shaft 16, for example, to give clearance alongside the operating lever 24 when the scissors 10 are folded as shown in FIG. 3 and stowed in a cavity within the handle 12.

Referring still to FIG. 4, it may be seen that the rivet 30 includes a shoulder 36 larger in diameter than the body 38 of the rivet 30, and the body 38 extends rotatably through a straight bore 39 through a base portion 44 of the second blade 26. The extent of peening the outer end 34 controls an amount of axial clearance along the body 38 of the rivet 30, as at 41, between the second blade 26 and the operating lever 24, when the scissors are in the folded configuration as shown in FIG. 3, so that the operating lever 24 is held alongside the second blade 26. Preferably, the operating lever 24 can be moved easily from the position shown in FIG. 3 by application of a small force, yet is not so loose that it can simply fall out of the folded configuration.

With the shoulder 36 held closely against the face of the second blade 26 adjacent the bore 39, the preformed head 32 of the rivet 30 and the chamfered bore 40 in the first scissors blade 18 cooperate to keep the second blade 26 closely alongside the first scissors blade 18 yet permit the blades 18 and 26 to pivot with respect to each other and the rivet 30. Alternatively, should the rivet 30 have no such shoulder 36, the axial clearance along the body 38 of the rivet 30 will affect the clearance between the blades 18 and 26 during use of the scissors. Excess clearance between the blades 18 and 26 can be taken up while still allowing the operating lever 24 to move easily with respect to the second blade 26 by peening the margin 42 of the preformed head 32 to ensure that the blades cooperate closely to cut in scissors fashion if the chamfered bore 40 and the preformed head 32 do not fit each other precisely as desired.

Figure 5:
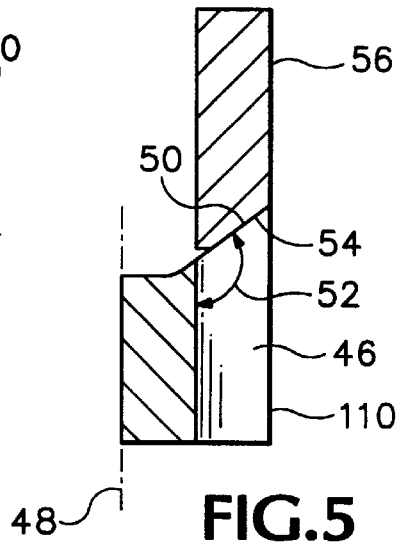
FIG. 5 is a section view taken along line 5—5 of FIG. 1.
Figures 6, 7:
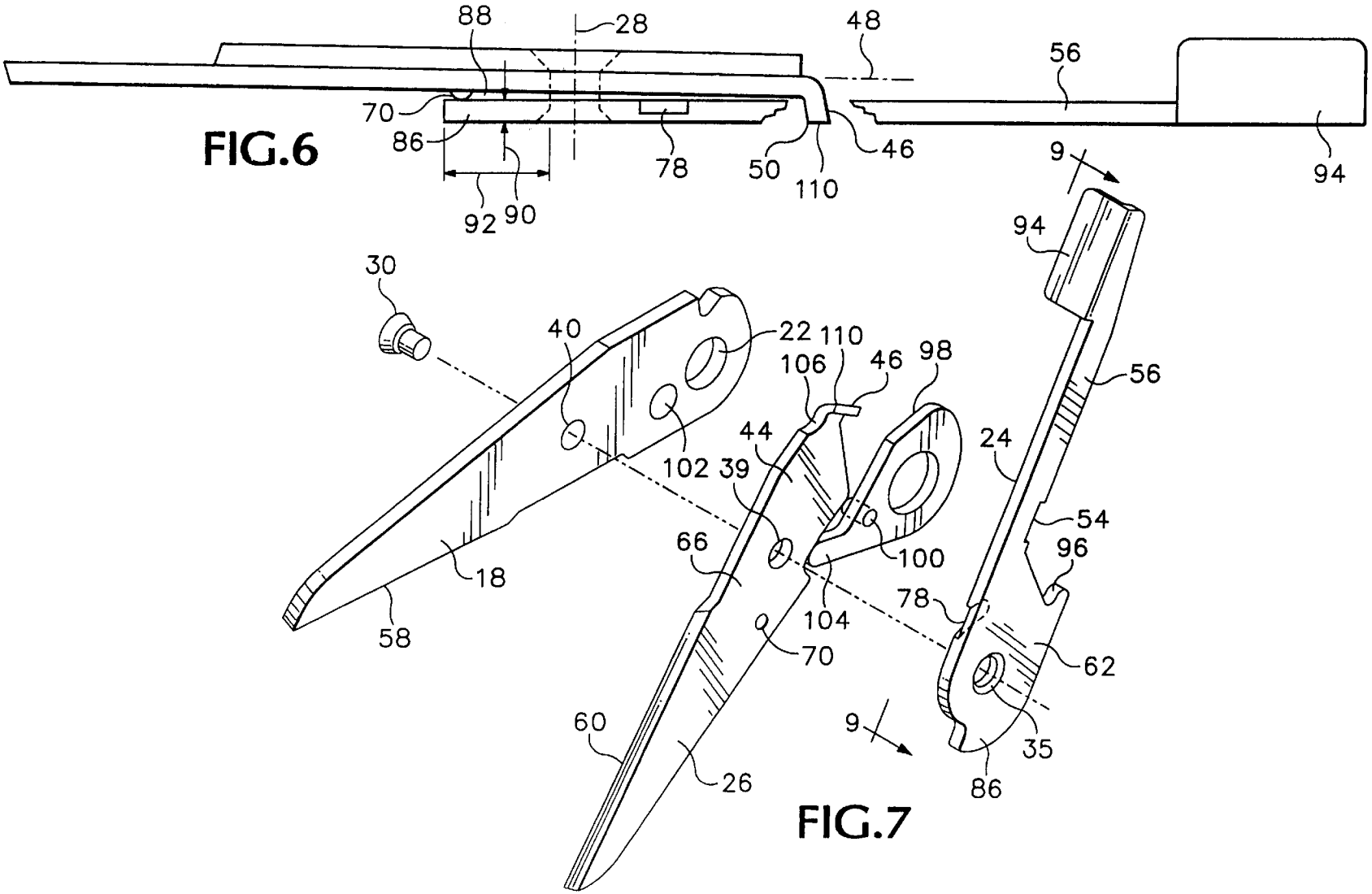
FIG. 6 is a partially cutaway view of the scissors shown in FIG. 1, taken in the direction of line 6—6.
FIG. 7 is an exploded isometric view of the scissors shown in FIG. 2.

Referring also to FIGS. 5, 6 and 7, the second blade 26 has a base portion 44 that includes a hook 46 that extends away from the first blade 18 into the plane of rotation of the operating lever 24 about the pivot axis 28. Movement of the operating lever 24 in a clockwise direction as shown by the arrow 47 in FIGS. 1 and 2 thus brings the operating lever 24 to bear against the hook 46. The path of the sharp edge 60 of the second blade, as the second blade moves about the pivot axis 28, defines a blade plane 48. The upper side of the hook 46, at the rear of the base portion 44 of the second blade includes an engagement surface 50 which is inclined at an obtuse angle 52 which may be about 135 degrees, for example, with respect to the blade plane 48, as may be seen in FIG. 5. A cooperating inclined engagement surface 54, which may be inclined with respect to the blade plane 48 at an acute angle that supplements the angle 52, and thus is about 45 degrees in the embodiment of the invention shown in the drawings is provided on a chamfered portion of the lower margin of the lever arm portion 56 of the operating lever 24 ,as may also be seen in FIGS. 1 and 3. The inclined engagement surfaces 50 and 54 attempt to slide along each other in response to force applied to the operating lever 24 in a clockwise direction as shown by the arrow 47 in FIG. 1, drawing the lever arm 56 toward the base 44 of the second blade 26 and keeping the lever arm 56 tightly engaged with the hook 46. Further movement of the operating lever 24 in the same direction causes the second blade 26 to rotate clockwise about the scissors pivot axis 28 with respect to the first blade 18 in a scissors action. This causes respective cutting portions or edges 58 and 60 of the scissors blades to move toward each other in a cutting or blade-closing scissors action.

Figures 8, 9, 10, 11, 12:
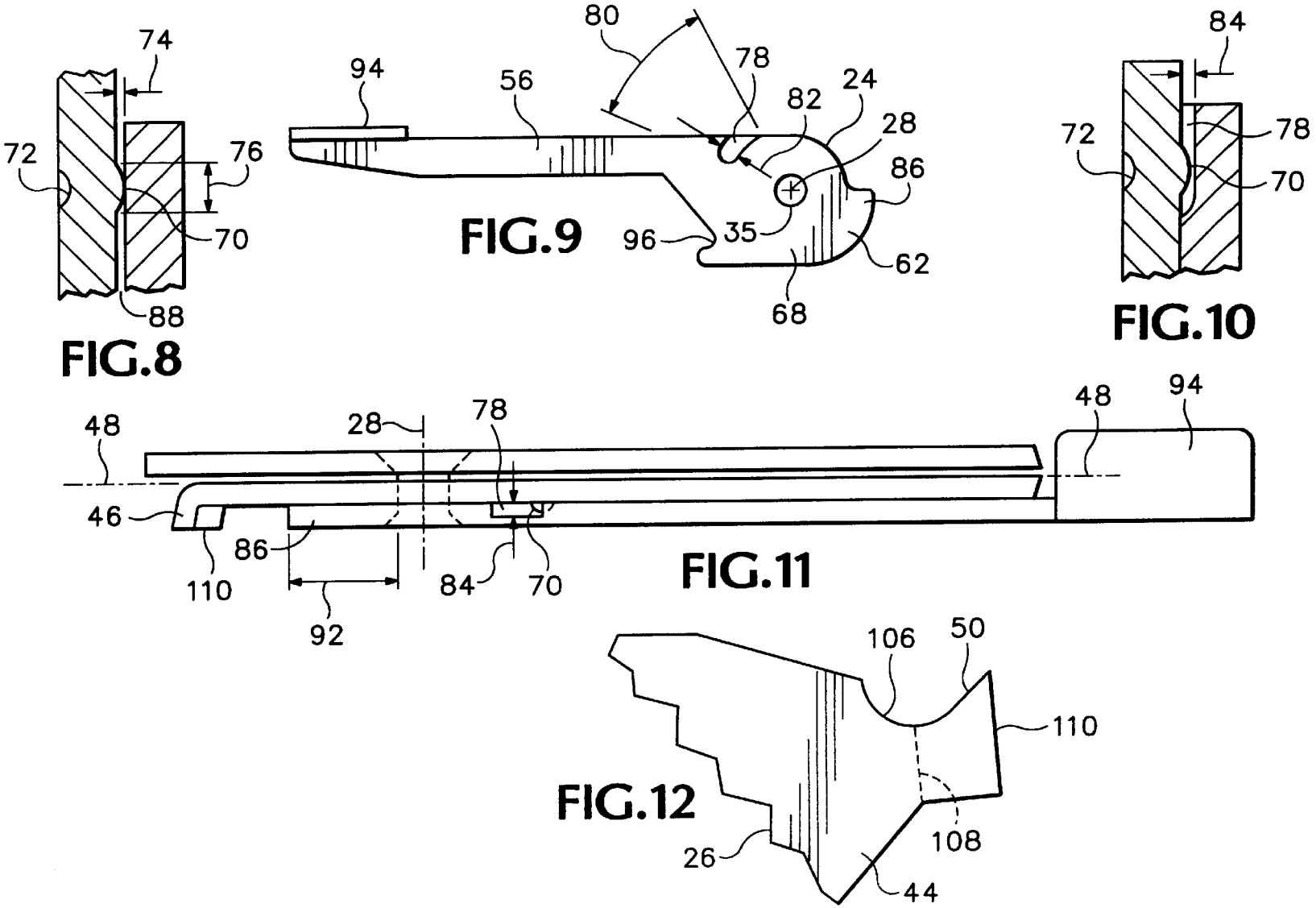
FIG. 8 is a section view taken along line 8—8 of FIG. 1.
FIG. 9 is a side elevational view of the operating lever of the scissors shown in FIGS. 1–7, taken in the direction of line 9—9 of FIG. 7.
FIG. 10 is a sectional view of a portion of the scissors shown in FIG. 3, taken along line 10—10.
FIG. 11 is a view of the scissors in the configuration shown in FIG. 3, taken in the direction of line 11—11.
FIG. 12 is a view taken in the same direction as FIG. 1, showing a detail of the second blade of the scissors at a preliminary stage during its manufacture.

The operating lever 24 has a base portion 62 defining the bore 35 through which the rivet 30 extends to interconnect the blades 18 and 26 with the operating lever 24, and the respective base portions 44 and 62 of the second blade 26 and the operating lever 24 have mutually confronting faces 66 and 68 seen best in FIGS. 7 and 9. A spacer 70 is provided on the second blade 26, protruding from the confronting face 66 thereof toward the face 68 of the base portion 62 of the operating lever 24. The spacer 70 may be a small bump, protruding from the second blade 26 and formed as by coining, leaving a corresponding dimple 72 in the opposite side of the second blade as shown in FIG. 8. The spacer 70 protrudes to a height 74 of about 0.002 inch in the form of a circular bump having a diameter 76 of approximately 0.027 inch in one embodiment of the invention. What is required is merely that the spacer have a height great enough to reduce excess axial clearance along the body 38 of the rivet 30 and cock the operating lever 24 slightly, about the pivot joint including the rivet 30, with respect to the second blade 26, so that the lever arm 56 will be kept securely engaged with the hook 46.

A cavity 78 in the form of a shallow arcuate groove is defined in the confronting face 68 of the base of the operating lever, as shown in FIG. 9, and extends through a small angle 80 measured about the pivot axis 28 of rotation of the operating lever. The cavity 78 is located in a position corresponding with the location of the spacer 70 when the operating lever 24 is in its folded position extending alongside and parallel with the second blade 26 as shown in FIG. 3. The cavity 78 has a width 82 considerably greater than the diameter 76 of the spacer 70, and has a depth 84 which is preferably at least 0.002 inch greater than the height 74 of the spacer 70. Thus, when the operating lever 24 lies alongside the second blade as shown in FIGS. 3 and 11, there is no interference between the operating lever 24 and the spacer 70.

A stabilizer portion 86 of the base portion 62 of the operating lever 24 extends radially away from the scissors pivot axis 28 in a position approximately opposite that of the lever arm 56. The location of the spacer 70 is approximately opposite that of the hook 46 on the second blade 26, with respect to the scissors pivot axis 28, so that when the operating lever 24 is moved to a position in which the engagement surface 54, on its chamfered portion, approaches the engagement surface 50 of the hook 46, the stabilizer portion 86 rides up onto the spacer 70. As shown in FIGS. 6 and 8, this has the effect of slightly increasing the amount of separation at 88, between the confronting faces 66 and 68 of the base portions 44 and 62 of the second blade 26 and the operating lever 24, while also tending to move the lever arm 56 toward the base portion 44 of the second blade 26 adjacent the hook 46 to the extent permitted by any clearance between the peened outer end 34 of the rivet 30 and the chamfered bore 35 in the base 62 of the operating lever 24. When the operating lever 24 is rotated with respect to the second blade 26 away from the position shown in FIG. 2 the stabilizer no longer engages the spacer 70.

The operating lever 24 has a thickness 90, and the stabilizer 86 extends radially away from the body 38 of the rivet a distance 92 sufficient to stabilize the operating lever 24 relative to the second blade 26 and urge the lever arm 56 toward the base 44 of the second blade 26. For example, in the scissors 10 shown herein the distance 92 is 0.236 inch, more than four times the thickness 90, which is 0.040 inch.

A handle tab 94 on the operating lever 24 extends transversely in the direction toward the blades 18 and 26. The tab 94 provides a surface against which to push comfortably to operate the scissors and is spaced far enough away from the scissors pivot axis 28 that the tab 94 passes clear of the tips of the blades 18 and 26 as the scissors 10 are folded to the configuration shown in FIG. 3. When the scissors 10 are folded the cutting portions or edges 58 and 60, respectively, of the first and second scissors blades 18 and 26 are in a fully closed position.

A small ear defines a notch 96 in the base portion 62 of the operating lever 24 that can be engaged by a fingernail to start to move the operating lever 24 from its folded position, far enough to raise the tab 94 from within the handle 12 far enough to be gripped.

A rocker 98 includes a pin 100 extending to the far side of the rocker 98, as shown in FIG. 7, and the base portion 20 of the first blade 18 defines a corresponding hole 102 into which the pin 100 protrudes laterally from the rocker 98 so that movement of the first blade 18 more than a small distance about the axis 14 also moves the rocker 98 linked to the first blade 18 by the interaction of the pin 100 and the hole 102.

As the operating lever 24 is rotated in a clockwise direction beyond the position shown in FIGS. 1 and 2, moving the edges 58 and 60 along each other, further movement of the blade 26 about the axis 28 pushes the base portion 44 of the second blade 26 toward and into contact with the rocker 100. The rocker 100 limits movement of the second blade 26 beyond a closed position with respect to the first blade 18 so that subsequent clockwise movement of the operating lever 24 as shown in FIG. 1 moves the entire folding scissors 10 clockwise by moving the first scissors blade 18 about the tool pivot shaft 16. The base portion 20 of the first blade 18 includes a stop that abuts against the handle 12 to limit movement of the first blade 18 relative to the handle 12 in a clockwise direction about the tool pivot shaft 16 at the appropriate position.

When the scissors 10 are in the operating configuration a spring (not shown) urges the rocker 98 to rotate in a clockwise direction relative to the first blade 18 as shown in FIG. 1 until a finger 104 on an outer end of the rocker 98 presses against the base portion 44 of the second blade 26 as shown in FIG. 7. The rocker 98 thus urges the second blade 26 to move in a counterclockwise direction, opening the cutting edges 56 and 58 apart from each other toward an open position of the scissors blades 18 and 26. The hook 46 of the second blade 26 presses in reaction against the operating lever 24, carrying the operating lever 24 along with counterclockwise opening movement of the second blade 26.

To use the scissors to cut an object, then, it is merely necessary to push against the handle tab 94 of the operating lever 24, urging it toward the handle 12 as indicated by the arrow 47. This rotates the second blade 26 clockwise about the scissors pivot axis 28 and moves the cutting edges 58 and 60 closer together and along each other in a normal scissors cutting motion.

As shown in FIG. 12, the hook 46 may be made by cutting a flat sheet of metal to define a concave portion 106 in a margin of a rear portion 44 of the second blade 26. A bend is formed near or along the line 108 to form the hook 46 so that the engagement surface 50 is then oriented to mate against the engagement surface 54 of the lever arm 56. Thereafter, the outer end face 110 is defined by cutting as necessary so that the hook 46 extends no further than the thickness of the operating lever 24, as shown best in FIGS. 5, 6 and 11.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A pair of folding scissors, comprising:

(a) a first blade;

(b) a second blade located alongside said first blade and movable in a blade plane for scissors action with respect to said blade plane, said second blade including a base portion and a hook located on said base portion and extending away from said blade plane, and said hook including a first engagement surface;

(c) an operating lever located closely alongside one of said first and second blades and thereby spaced apart from the other of said blades, said operating lever including a second engagement surface; and (d) a pivot joint interconnecting said operating lever with said one of said blades, said operating lever being movable with respect to said second blade about an axis defined by said pivot joint, between a folded position and a scissors-operating position in which said first and second engagement surfaces are in contact with each other and further movement of said operating lever with respect to said second blade is thereby limited, at least one of said engagement surfaces being oriented at such an angle with respect to said blade plane that a portion of said operating lever including said second engagement surface is wedged laterally toward said base portion of said second blade by said at least one of said engagement surfaces, in response to force urging said operating lever around said axis in a direction urging said second blade in a blade-closing direction with respect to said first blade when said operating lever is in said scissors-operating position.

2. The pair of folding scissors of claim 1 wherein said operating lever is located closely alongside said second blade and said hook extends away from said first blade.

3. The pair of folding scissors of claim 1 wherein said first and second engagement surfaces are each oriented at such a respective angle with respect to said blade plane that said engagement surfaces cooperate with each other to urge said portion of said operating lever toward said base portion.

4. The scissors of claim 1 wherein said first and second blades and said operating lever are all interconnected with each other for movement with respect to each other about said pivot joint, said operating lever including a lever arm and a base portion, said one of said blades and said base portion of said operating lever including respective confronting faces and said scissors including a spacer located on one of said confronting faces and between a part of said base portion of said operating lever and said one of said blades when said operating lever is located in said scissors-operating position with respect to said second blade.

5. The scissors of claim 4 wherein one of said confronting faces includes a cavity defined therein, said spacer being located on the other of said confronting faces and protruding into said cavity when said operating lever is in said folded position with respect to said second blade.

6. The scissors of claim 5 wherein said operating lever is located closely alongside said second blade, said hook located on said base portion extends away from said first blade, and said spacer is located on and protrudes outwardly from said second blade in a direction away from said first blade, and wherein said cavity is defined in said base portion of said operating lever.

7. The scissors of claim 4 wherein said base portion of said operating lever includes a stabilizer portion and said spacer separates said stabilizer portion from said one of said blades when said operating lever is located in said scissors-operating position.

8. A pair of folding scissors, including:

(a) a first blade;

(b) a second blade located alongside said first blade and having a base defining a hook extending laterally away from said first blade, said second blade being movable with respect to said first blade, and said base of said second blade defining a first bore extending therethrough;

(c) an operating lever, located alongside said second blade and moveable with respect to said second blade between a folded position and an operating position, said operating lever including a lever arm;

(d) a pivot shaft extending through said bore and pivotally interconnecting said first and second blades and said operating lever with each other and establishing a first axial clearance distance between said first and second blades when said operating lever is located elsewhere than in said operating position;

(e) a stabilizer portion included in said operating lever and located generally opposite said lever arm with respect to said pivot shaft;

(f) a spacer carried on a selected one of said second blade and said operating lever and separating said stabilizer portion of said operating lever from said second blade when said operating lever is in said operating position with respect to said second blade.

9. The folding scissors of claim 8, one of said second blade and said operating lever defining a cavity therein and said spacer being located in said cavity when said operating lever is located in said folded position with respect to said second blade.

10. The folding scissors of claim 9 wherein said spacer is located on said second blade and protrudes away from said first blade and toward said operating lever, and wherein said cavity is defined in said operating lever and faces toward said second blade.

11. The folding scissors of claim 8 wherein said operating lever has a thickness and a base portion including said stabilizer portion, and wherein said stabilizer portion of said base portion of said operating lever extends radially away from said pivot shaft a distance at least four times said thickness.

12. The folding scissors of claim 8 wherein said spacer engages both said second blade and said operating lever only when said operating lever is located substantially in said operating position with respect to said second blade.

13. The folding scissors of claim 8 wherein said spacer urges said second blade toward said first blade along said pivot shaft and establishes a second, reduced, axial clearance distance between said first and second blades along said pivot shaft when said operating lever is in said operating position.

* * * * *